US006212988B1

(12) United States Patent
Chernyshov et al.

(10) Patent No.: US 6,212,988 B1
(45) Date of Patent: Apr. 10, 2001

(54) SELF SUSTAINED DETONATION APPARATUS

(75) Inventors: Alexandr Vladimirovich Chernyshov, Quebec (CA); Georgiy Yur'evich Barykin, San-Sebastian (ES); Sergey Nikolaevich Lakiza, Quebec (CA)

(73) Assignee: Aerostar Coatings, S.L., Irun (ES)

( * ) Notice: Subject to any disclaimer, the term of this patent is extended or adjusted under 35 U.S.C. 154(b) by 0 days.

(21) Appl. No.: 09/125,586

(22) PCT Filed: Dec. 24, 1997

(86) PCT No.: PCT/EP97/07300

§ 371 Date: Jan. 12, 1999

§ 102(e) Date: Jan. 12, 1999

(87) PCT Pub. No.: WO98/29191

PCT Pub. Date: Jul. 9, 1998

(30) Foreign Application Priority Data

Dec. 28, 1996 (UA) ..... 96124958

(51) Int. Cl.[7] ..... F41A 1/04
(52) U.S. Cl. ..... 89/7
(58) Field of Search ..... 89/7, 8

(56) References Cited

U.S. PATENT DOCUMENTS

| | | | | |
|---|---|---|---|---|
| 2,986,072 | * | 5/1961 | Hudson | 89/7 |
| 4,653,380 | * | 3/1987 | Griffing et al. | 89/7 |
| 5,149,907 | * | 9/1992 | Thiesen | 89/7 |

FOREIGN PATENT DOCUMENTS

| | | | | |
|---|---|---|---|---|
| 36 14 098 | | 10/1987 | (DE) . | |
| 0 402 471 | | 12/1990 | (EP) . | |
| 2 499 874 | | 8/1982 | (FR) . | |
| 2 590 907 | | 6/1987 | (FR) . | |
| 100408 | * | 5/1916 | (GB) | 89/7 |

* cited by examiner

*Primary Examiner*—Stephen M. Johnson
(74) *Attorney, Agent, or Firm*—Israel Gopstein

(57) ABSTRACT

A detonation coating apparatus that coats a substrate with a coating powder which is propelled by the products of a detonation. The present invention increases the rate at which the coating is applied by increasing the detonation rate of the combustible gas mixture. The detonation coating apparatus is a self-detonating apparatus designed to create a secondary pressure within a combustion chamber. This secondary pressure combines with an initiating element, which is heated by detonation to a temperature, to ignite the combustible gas mixture as rapidly as the secondary pressure originates.

26 Claims, 2 Drawing Sheets

SELF SUSTAINED DETONATION APPARATUS

OBJECT OF THE INVENTION

The present invention generally relates to the field of gas detonation coating technology and, more particularly is concerned with increasing the detonation rate of a gas detonation coating apparatus through self sustained detonation.

A self sustained detonation apparatus, like the one described in the present invention, is also related to the "Pulse Combustion Devices". These have been developed mainly for propulsion applications (from the early "Pulse Jets", like the German V1 "Buzz Bomb" used in World War II, to the more recent "Pulsed Detonation Engines", PDE's) but have also been found to be valuable for applications such as drying, smelting, water heating and slurry atomization. This invention is concerned with the development of a particular "Pulse Detonation Device" to be used, specially but not exclusively, as a Detonation Coating Apparatus.

BACKGROUND OF THE INVENTION

Coatings commonly protect substrates from the effects of exposure to severe environmental conditions such as heat, wear and corrosion. A significant factor in the coating's protection ability relates to the manner in which the coating is applied to the substrate. In many industrial applications, coatings are applied via thermal spraying techniques. Two (2) types of thermal spraying apparatus include HVOF (High Velocity Oxygen Fuel) guns and detonation guns.

In a HVOF gun, a continuous high temperature combustion creates a supersonic high energy flow stream. A coating powder interjected into the continuous high energy flow stream, typically within the barrel of the HVOF gun, forms a coating when applied to a substrate. In contrast, the detonation gun, which operates in a pulsed manner, uses kinetic and thermal energy from the detonation of combustible gases to deposit powdered coating materials onto substrates in a pulsed manner. A combustion chamber receives a certain amount of fuel and oxidant gas. A spark plug ignites the combustible gas mixture to initiate combustion which transforms into detonation. The shock wave formed by this detonation travels at a supersonic speed from the combustion chamber into the barrel where a suitable coating powder is typically injected. The shock wave and further expanding detonation products propel the coating powder out of the barrel and deposit it onto a substrate, thereby forming a coating layer. This process repeats until the substrate obtains a sufficient coating thickness. In some detonation spray systems, between successive ignitions, an inert gas, such as nitrogen, is fed into the combustion chamber to halt combustion and prevent backfire into the fuel and oxygen supply, and to purge the combustion chamber and barrel of combustion detonation products.

The mechanics of detonation are key to the operation of the detonation gun. Detonation produces shock waves that travel at supersonic velocities, as high as 4,000 meters per second (m/s), and elevated temperatures, as high as 3,000 degrees Celsius. Detonation within the detonation gun is controlled by the type and amount of fuel (i.e., natural gas, propane, acetylene, butane, etc.), the fuel and oxygen mixture ratio, the initial pressure of the gases in the combustion chamber, and the geometry of the combustion chamber. Cycled ignition of a portion of the combustible mixture creates combustion which increases the entropy within the combustion chamber and, in turn, propagates ignition of the combustible mixture throughout the combustion chamber. With the correct combination of parameters which result in sufficient local pressure and temperature within a given volume, accumulated combustion energy provides transition to detonation.

At a fixed moment in time the detonation wave front is made up of a system of individual detonation cells. The behavior of detonation at the cell level is an important attribute in the control and operation of a typical detonation gun. The detonation cell is a multidimensional structure, which is formed under influence of both the shock wave front and transverse shock waves. The propagation of the shock wave front, created by detonation, is perpendicular to the inner circumference of the combustion chamber and it is directed from the closed end of the combustion chamber to the open end of the combustion chamber. Transverse shock waves also form at the inner circumference of the combustion chamber and move toward and out the central line of the combustion chamber. Under the current description, a detonation wave constitutes the final case of the multidimensional structure of the detonation front that includes a number of traverse shock waves.

The frontal surface of a detonation cell has a convex shape. Behind the frontal surface is a reaction zone where the chemical reactions take place. At the edge of the cell, transverse shock waves form at substantially right angles to the frontal surface of the detonation cell. The transverse waves have acoustic tails that extend from the aft edges of the transverse waves and define the aft edge of the detonation cell. The transverse waves move from cell to cell and reflect off of each other and off of any limiting structure such as the combustion chamber wall. Once detonation has been initiated, the reaction continues in a fairly stable fashion if subsequent detonation cycles are initiated and maintained under similar conditions as the previous detonations.

The shock wave moves from the closed end of the combustion chamber toward the open end of the combustion chamber and into the barrel. It is of particular importance that the combustion chamber be of sufficient length and sufficient diameter to complete the transition from combustion to detonation before entering the barrel, otherwise, the accumulated energy may dissipate within the barrel. It is also important in the operation of a detonation gun to produce a shock wave and direct it to the barrel as efficiently as possible so that a large amount of the kinetic and thermal energy of the gaseous detonation products goes directly to carrying the powder out of the barrel and onto the substrate. However, reflecting transverse waves colliding with other wave structures can collapse, thus diminishing both the speed of the detonation wave and the transfer of detonation energy as it travels through the combustion chamber. These collisions reduce the amount of the energy available to be transferred to the coating powder which decreases the adherence characteristics between the coating and the substrate and lowers the density of the coating itself.

The size of the detonation cell is another important attribute in the control and operation of a detonation gun. Cell size is a function of the molecular nature of the fuel, the initial pressure within the combustion chamber and the fuel/oxygen ratio. The particular cell size for certain conditions can be determined experimentally. The width of a cell, Sc, is measured along the wave front between successive transverse waves. The length of a cell, Lc, is the perpendicular distance from a line tangent to the wave front measured to the intersection point of the acoustic tails from adjacent transverse waves. The typical ratio of cell width, Sc, to cell length is $Sc=0.6Lc$ for the detonable gases under consideration. The physical parameters of a particular detonation gun, such as the geometry and operating pressures, are determined by the cell size of a particular fuel and oxygen mixture.

In a typical detonation gun the components of the detonable mixture are fed into the combustion chamber and, the coating powder is fed directly into the barrel by inert gases ahead of the detonation wave. A certain gas content system and different gases supplied from a continuous source through a valve arrangement of the gun. For example, the operation of the powder valve is coordinated with the firing of the spark plug so that the powder and carrying gases are in position along the barrel to be properly effected by the detonation wave. Typically the gas control valves are opened by mechanical means such as a cam and tappets or a solenoid which pose reliability problems in that they have rapidly moving pieces. The powder valve is responsible for the transportation of the powders that tend to be abrasive in nature leading to gun life cycle and maintenance concerns. In addition, valves pose safety concerns in that a valve that leaks, sticks open or breaks gives an alternate and potentially harmful path for the detonation products to escape. A further disadvantage of these mechanisms is that they often limit the frequency at which the gun can fire because the valve must be opened far enough and long enough to permit the passage of the proper amount of gas through the valve.

The rate at which a detonation gun deposits the coating powder on the substrate is an important economic parameter in industrial applications. The deposition rate is controlled, and at times limited, by a variety of factors such as the type of fuel, the fuel supply system, the geometries of the combustion chamber and barrel, the powder feeder system, the purging of the system between successive initiations and the frequency with which the combustible gas mixture detonates. Deposition rate is expressed as the ratio between the spray rate and the area sprayed ("spray spot square"). The spray rate is stated in terms of the mass of coating powder utilized per unit time, typically Kg/hr, and typically ranges from 1 to 6 Kg/hr. Spray rate is obviously influenced to great extent by the rate at which the combustible gas mixture detonates. In a typical detonation gun a spark plug is the means to ignite the combustible gas mixture and detonates at the maximum rate of 6 to 10 times per second. The spray spot square is the area coated by a single detonation of the gun and is roughly equal to the area of the barrel and is typically expressed as $mm^2$. A typical industrial detonation gun has a deposition rate of about 0.001 to 0.02 $Kg/mm^2$-hr.

In the typical detonation gun the combustible fuels and oxygen are supplied either into a mixing chamber or directly into the combustion chamber itself through a series of valves. The combustible gases are supplied under pressure of about 1 to 3 MPa from a continuous source to the valve system before being issued into the gun. As discussed previously, a valve system, as employed in a typical detonation gun, raises serious concerns about rate, reliability and safety.

An important characteristic affecting coating quality is the supersonic velocities at which the shock waves travel. The shock wave initiates the acceleration of the coating powders, while the detonation products move the coating powders to produce high density coatings with better adhesive qualities than other spray coating methods. The velocity of the coating powder as it exits the barrel is influenced by, among other things, the type of fuel used and the geometries of the combustion chamber and barrel. Typical detonation wave velocities for detonable gas mixtures are about 1,200 m/sec to about 4,000 m/sec. For example hydrogen-oxygen detonation wave velocities are about 2,830 m/sec and methane-oxygen are about 2,500 m/sec. The maximum achievable velocity in prior art detonation gun configurations is approximately 3,000 m/sec.

Another characteristic effecting coating quality is the temperatures surrounding the operation of a detonation gun which effects the coating density. In order to apply a dense coating, the powder must melt within the barrel of the detonation gun. The higher the adiabatic flame temperature of the combustible gas mixture, the easier it is for the coating powder to melt. Typical adiabatic flame temperatures for detonable gas mixtures of concern range from about 1,900° C. to about 3,200° C., with hydrogen-oxygen about 2,807° C. and methane-oxygen about 2,757° C. The heat imparted to the powders is a function of many parameters including the barrel geometry and the active cooling of the barrel. These temperatures are high enough to melt most substrate materials, however, the discontinuous nature of the detonation within a detonation gun and the quick heat dissipation in the atmosphere between the gun barrel and the substrate prevents the substrate from being adversely affected.

The use of non-combustible gases, inert gases, in the operation of a detonation gun also effects the quality of the coatings produced by reducing the density of the coating as well as adversely effecting the adhesion characteristics between the coating and the substrate. Three common uses of non-combustible gases in detonation gun operations include: 1. purging gases; 2. powder carrier gases; and 3. a control on the detonation process. Purging gases typically are inert gases and are used primarily to purge the combustion chamber between successive firings of the spark plug to arrest the combustion process. This is important in the typical detonation gun because the combustion chamber must be filled between successive firings of the spark plug with new amounts of combustible fuel and oxygen mixture through a series of valves. If combustion continued in the combustion chamber while the valves are opened it is possible that the combustion would continue into the fuel and oxidant gas supply and cause an explosion. One of the problems with using purging gases is that they mix with the combustible gases and lower the overall energy of the detonation. Consequently, the heat and kinetic energy available for transferring to the coating powders is reduced and coating density and adhesion are adversely affected.

Powder carrier gases, frequently compressed air, are typically used to transfer the coating powders from a reservoir to the barrel of the detonation gun in front of the detonation wave. In large quantities, these gases also reduce the kinetic energy available for transfer to the coating powders since they decrease the temperature and velocity of the detonation wave front. The effect on coating quality is evidenced by a lower density coating and poor adhesion to the substrate. Finally, inert gases are also mixed with the detonable gases as a control on the detonation process. These gases are typically used in small amounts to control the temperature, velocity and chemical environment of the detonation products, and the detonation stability.

What is needed in the art is a unique self sustained detonation gun.

DESCRIPTION OF THE INVENTION

The present invention relates to an apparatus and a method for producing detonation through self sustained detonation. The self sustained detonation apparatus comprises a combustion chamber, a means for introducing fuel and oxidant gas to the combustion chamber to form a mixture, a means for igniting the combustible fuel and oxidant gas and a means for creating a secondary pressure within the combustion chamber in order that the means for creating a secondary pressure combines with the means for igniting to establish an environment which provides self ignition of the mixture and initiates subsequent detonation.

The method includes the steps of: (a) supplying fuel and oxidant gas to the combustion chamber; (b) igniting the fuel and oxidant gas to produce a detonation wave; and (c) creating a secondary pressure within the combustion chamber wherein the secondary pressure coupled with the means for igniting combines to provide the appropriate conditions for self ignition of the fuel and oxidant gas to initiate the next detonation.

The present invention will now be described and explained in greater detail with reference to the embodiments shown in the drawings. The features shown and described in the specification and the drawings are merely exemplary and may be used in other embodiments of the invention either individually or in any desired combination there of.

PREFERRED EMBODIMENT OF THE INVENTION

Ignition of a combustible gas mixture, which is a combination of fuel and oxidant gas, is dependent upon the temperature and pressure within a combustion chamber and the composition of the combustible gas mixture, while detonation is dependent upon the temperature and pressure within the combustion chamber and the volume thereof. For the following description assume that the composition of the combustible gas mixture remains constant. Therefore, as pressure within the combustion chamber increases, the required ignition temperature decreases and vice versa, within certain limits. Upon ignition of the combustible gas mixture, the temperature and pressure increase, to a level where the amount of energy accumulated attains its detonation point, detonation is initiated and a detonation wave begins to propagate through the combustion chamber.

Figure 1:
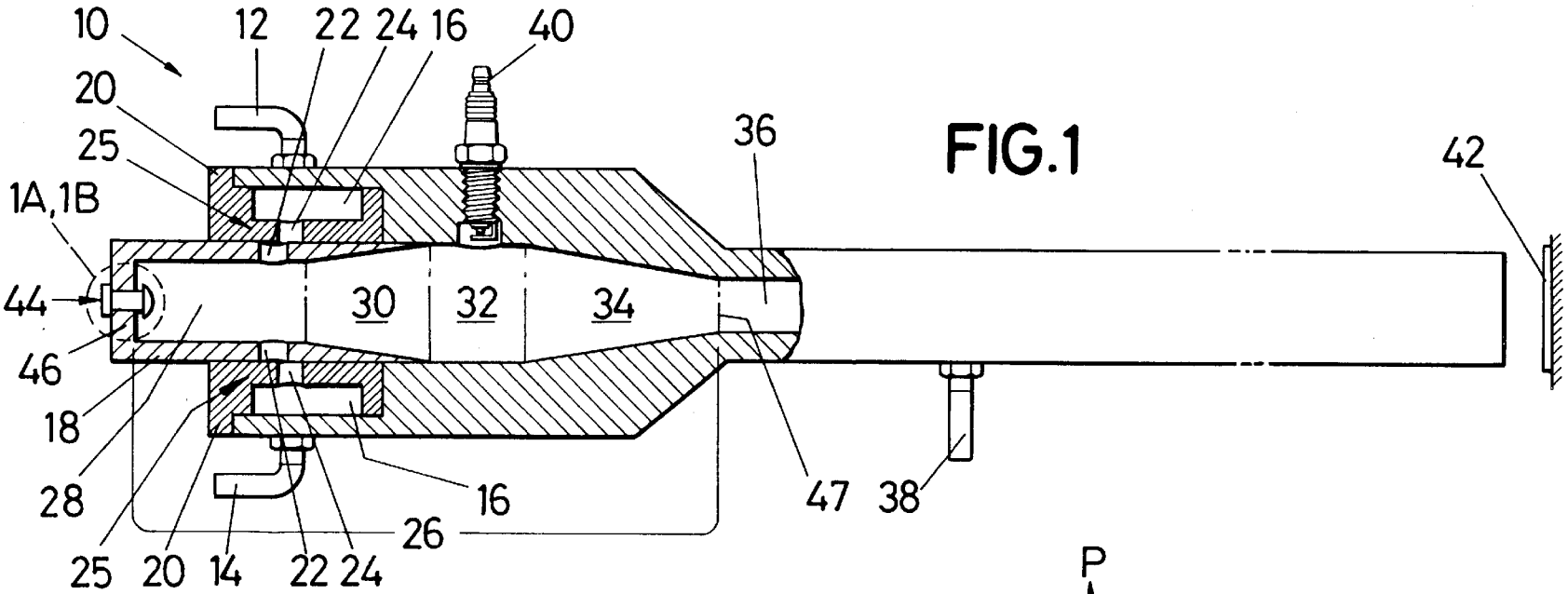
FIG. 1 is a plan view, partially in section, of one embodiment of the detonation gun of the present invention.

FIG. 1 illustrates a detonation coating apparatus, such as a detonation gun generally designated 10. The detonation gun 10 includes a fuel supply 12, an oxidant gas supply 14, a mixing chamber 16, a combustion chamber 26, a barrel 36, a powder supply 38, a spark plug 40 and an initiating element 44.

The fuel and the oxidant gas can be combined in the mixing chamber 16 to produce a substantially homogenous combustible gas mixture prior to entering the combustion chamber 26. The fuel supply 12 provides fuel (i.e., natural gas, propane, etc.) to the mixing chamber 16 while the oxidant gas supply 14 provides oxidant gas (i.e., oxygen or air). It is generally preferred that the combustible gas mixture enter the ignition section 28 of the combustion chamber 26 in order that combustion occur as close as possible to the closed end 46, thereby allowing energy resulting from combustion to accumulate and detonate prior to reaching the barrel 36. Both the fuel supply 12 and the oxidant gas supply 14, furnish fuel and oxidant gas, respectively, at a positive pressure and flow rate sufficient to supply the combustion chamber 26 with fuel and oxidant gas during the time interval between the reflection pressure peak and the subsequent detonation pressure peak.

In order to prevent combustion or detonation from extending into the mixing chamber 16, oxidant gas supply 14, or fuel supply 12, the combustible gas mixture preferably passes through a labyrinth 25 prior to entering the ignition section 28. The labyrinth 25 is created, for example, when a first hole 22 of a first bushing 18 and a second hole 24 of a second bushing 20 overlap to form a passageway. The passageway has a size large enough to allow the combustible gas mixture to flow easily from the mixing chamber 16 to the ignition section 28 but small enough to prevent a detonation cell from passing through the passageway from the ignition section 28 to the mixing chamber 16, oxidant gas supply 14, or fuel supply 12. Preventing a detonation cell from passing through the passageway minimizes the possibility of combustion extending from the combustion chamber 26 into the mixing chamber 16, the fuel supply 12 or the oxidant gas supply 14.

When the combustible gas mixture enters the ignition section 28, a spark creating device, such as a spark plug 40 or an initiating element 44, ignites the combustible gas mixture causing combustion. Combustion increases the temperature and pressure within the combustion chamber 26, thereby increasing the energy level, due to the volume thereof, and transitioning to detonation. Detonation produces a supersonic detonation wave of numerous detonation cells. The detonation wave preferably passes from the ignition section 28 through the diverging section 30, intermediate section 32 and converging section 34 before entering the barrel 36. (See FIG. 2A).

Detonation preferably occurs prior to the barrel 36 in order to efficiently propagate powder onto a substrate 42. It is especially preferred that detonation occur prior to the converging section 34 so that detonation waves may reflect off the converging section 34 and create a reflection pressure within the combustion chamber 26. The barrel 36 is an elongated chamber through which the detonation wave passes prior to exiting the detonation gun 10. A powder supply 38 typically introduces coating powder to the detonation wave as it passes through the barrel 36. The barrel 36 preferably has a sufficient overall length such the temperature of the powder introduced to the detonation wave has sufficient time to increase beyond its melting point, thereby increasing the density of the final coating. Although the powder supply 38 can be oriented to supply powder to the combustion chamber 26, it is preferably located a sufficient distance, measured from the open end 47 of the combustion chamber 26, along the barrel 36 to prevent the powder from entering and adhering to the interior of the combustion chamber 26.

While each detonation wave is traveling through the combustion chamber 26 and out the barrel 36, a subsequent ignition, combustion, detonation cycle is progressing in the ignition section 28 of the detonation gun. Since detonation is an exothermic reaction which releases significant energy, mostly in the form of heat of expanding detonation products, it causes the temperature of the initiating element 44 to increase. When the initiating element 44 attains a sufficient temperature for a given reflection pressure (discussed below), the two parameters create an environment which causes the combustible gas mixture to ignite and detonate. The initiating element 44 is generally located in the ignition section 28 of the combustion chamber 26 and preferably on the closed end 46 such that combustion may occur as close as possible to the closed end 46 allowing maximum time for combustion energy to be accumulated and to initiate detonation.

Figure 1B:
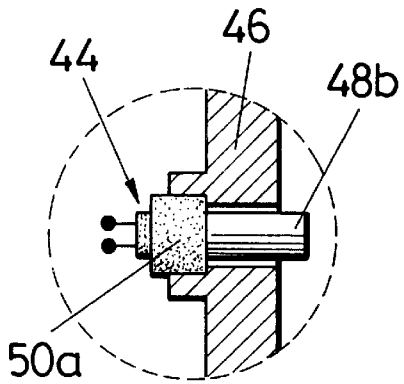
FIG. 1B is an enlarged view of an alternative embodiment of an initiating element of the present invention illustrated in FIG. 1.
Figure 1A:
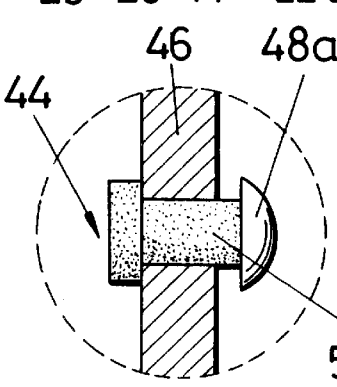
FIG. 1A is an enlarged view of one embodiment of the initiating element of the present invention illustrated in FIG. 1.

Referring to FIG. 1A, the initiating element 44 consists of a capacitor portion 48*a* and an insulating portion 50*a*. The capacitor portion 48*a* is fabricated from a material having a heat capacity capable of absorbing sufficient energy from detonation to establish combustion when a reflection pressure occurs. Preferably, the capacitor portion 48*a* is constructed of a material having a heat capacity such that it absorbs energy at a rate which allows the capacitor portion 48*a* to rise to a minimum temperature, sufficient to ignite the combustible gas mixture, in less than about ten detonations and preferably between about 2 and about 10 detonations. Once the capacitor portion 48*a* attains the minimum temperature, the spark plug 40 can be disconnected or switched off.

The insulating portion 50*a* of the initiating element 44 is preferably fabricated from a material such as ceramic which prevents energy stored within the capacitor portion 48*a* from transferring to the closed end 46 of the combustion chamber 26 in order that the combustible gas mixture may ignite consistently from the same location.

FIG. 1B illustrates an alternate initiating element 44 that does not require a spark creating device, such as a spark plug 40, to first ignite the combustible gas mixture. Rather, the capacitor portion 48*b* of the initiating element 44 is heated from an external source, such as electrically, to a temperature sufficient to ignite the combustible gas mixture. Once the detonation gun 10 is operational and the initiating element has achieved the desired temperature, the external power supply for the capacitor portion 48*b* may be switched off. The energy resulting from the detonation will maintain the temperature of the capacitor portion 48*b* above the minimum ignition temperature necessary to ignite the combustible gas mixture at the given reflection pressure.

The operating pressure within the combustion chamber is influenced by the behavior of the detonation cells. Prior to ignition, the pressure within the combustion chamber is controlled by the fuel and oxygen supply pressures and the geometry of the combustion chamber. After ignition of the combustible gas mixture the local pressure within the combustion chamber increases and reaches a maximum when detonation occurs. This initial maximum pressure is referred to as the detonation pressure peak (P1), see FIG. 2B. When the detonation wave travels down the barrel a rarefaction pressure peak (P3) is measured within the combustion chamber. The rarefaction pressure peak (P3) is the minimum pressure within a detonation cycle. Under certain conditions, a positive pressure peak is then subsequently measured within the combustion chamber due to the presence of reflected waves from the detonation wave front. This subsequent pressure peak is referred to as a secondary pressure peak or reflection pressure peak (P2) which is the second highest pressure peak within a detonation cycle.

Figure 2B:
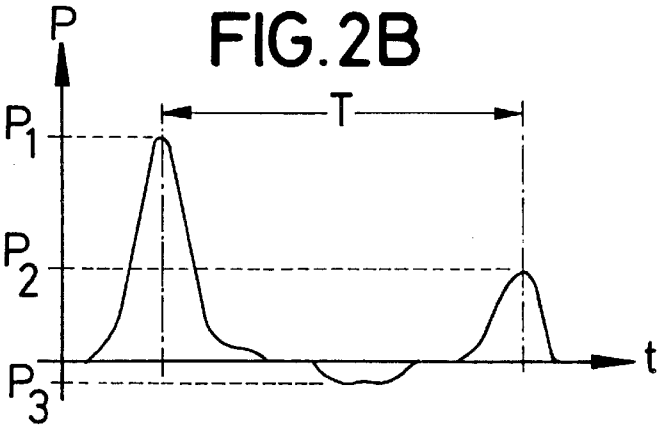
FIG. 2B is a pressure versus time graph of a detonation gun of the present invention.
Figure 2A:
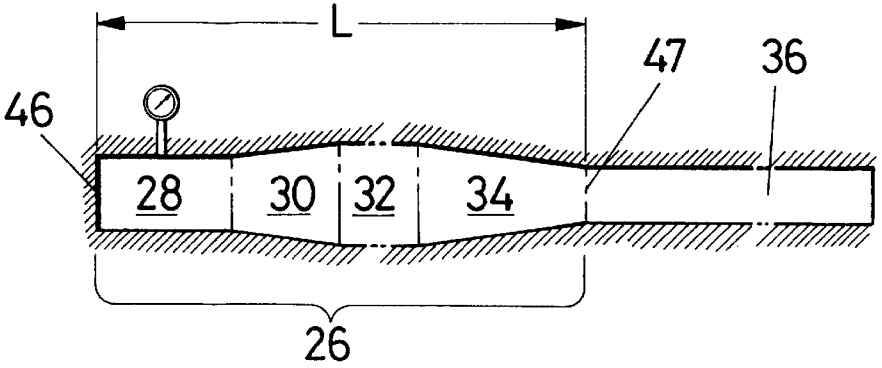
FIG. 2A is a plan view of a section of a detonation gun of the present invention.

Referring to FIG. 2B, which illustrates the pressure profile for a part of a detonation cycle, time (T), between the detonation pressure peak (P1) and the reflection pressure peak (P2). (P1) is the peak of the initial pressure due to detonation, while (P2) is the peak of the secondary pressure. As stated above, the secondary pressure is formed by the reflection of the initial detonation wave off the walls of the converging section 34 back toward the closed end 46 of the combustion chamber 26 creating a "reflection pressure" within the combustion chamber 26.

The reflection pressure increases the local pressure within the combustion chamber 26 to a level, which combined with the temperature of the initiating element 44, is sufficient to ignite the combustible gas mixture in the combustion chamber 26. The detonation cycle time is decreased by reducing length (L) of the combustion chamber 26. (See FIG. 2A). Decreasing length (L) decreases the time (T) between the detonation pressure peak (P1) and the reflection pressure peak (P2) (see FIG. 2B versus FIG. 3B). Operating the detonation gun 10 at its minimum detonation cycle time (T) increases the detonation rate.

As mentioned above, once detonation occurs, the detonation wave travels from its point of initiation toward the barrel 36. The maximum distance a detonation wave must travel to reach the barrel 36 is a distance (L). (See FIG. 2A). The distance (L) is measured from the closed end 46 of the combustion chamber 26 to the open end 47 of the combustion chamber 26 which is also the downstream end of the converging section 34.

Figure 3B:
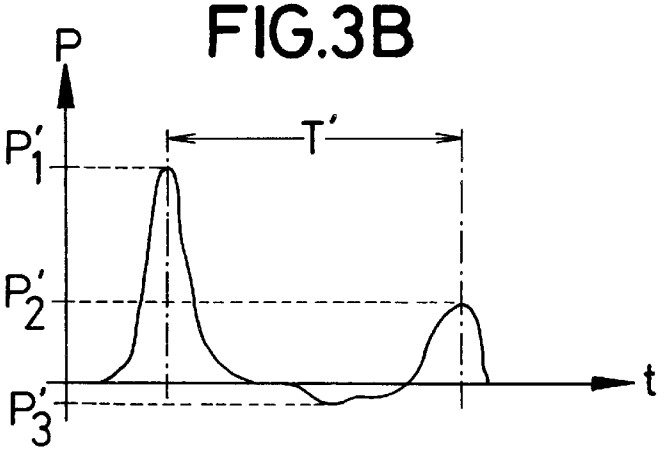
FIG. 3B is an alternate pressure versus time graph of a detonation gun the present invention.
Figure 3A:
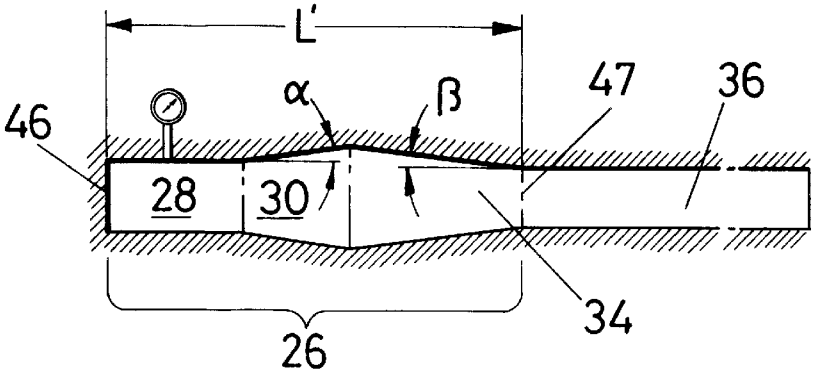
FIG. 3A is an alternate plan view of a section of a detonation gun of the present invention.

The time (T) required to complete a detonation cycle is dependent upon the time it takes a detonation wave to be supported from its point of initiation to the converging section 34 and back toward the ignition section 28. The maximum distance a detonation wave may possibly travel is, therefore, 2L if the point of initiation is exactly at the initiating element 44. As the length (L) decreases, the time (T) of the detonation cycle also decreases. As seen in FIG. 3A, the length (L') decreased upon removing the intermediate section 32 of the combustion chamber 26, thereby, as is shown in FIG. 3B, decreasing time (T') as compared to time (T). As may be understood from the dashed portion of intermediate section 32 in FIG. 2A, the length L of the intermediate section may be variable, and means (not shown) may be provided to adjust length L.

Figure 4:
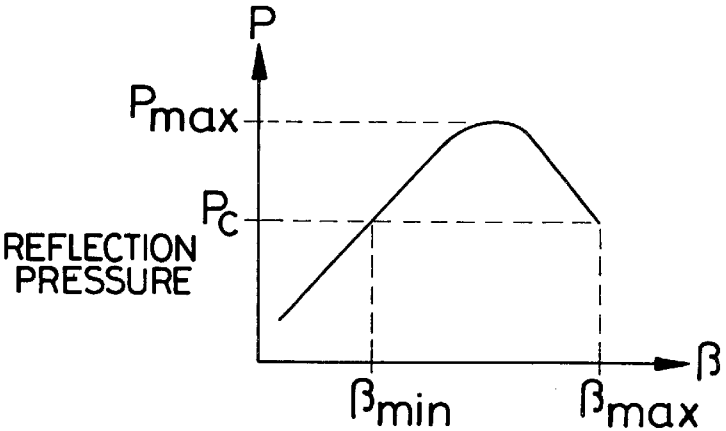
FIG. 4 is a reflection secondary pressure versus angle β graph of a detonation gun of the present invention.

In addition to the length of the combustion chamber 26, the detonation rate is also a function of the reflection pressure peak (P2) intensity. As the intensity of the pressure peak (P2) increases, the slope of the curve from the rarefraction pressure peak (P3), which is the minimum pressure the combustion chamber 26 experiences during a detonation cycle, to the reflection pressure peak (P2) increases. If the intensity of the reflection pressure peak (P2) increases, the combustible gas mixture will ignite sooner since the pressure within the combustion chamber 26 will attain the pressure necessary to ignite the gas in a shorter period of time. In order to attain the maximum detonation rate, the intensity of the pressure within the combustion chamber 26 must be at its maximum value, which is the maximum reflection pressure (Pmax). (See FIG. 4).

The reflection pressure is a function of angle β, which is the angle at which the converging section 34 retracts toward the barrel 36. (See FIGS. 3A and 4). As angle β increases, the pressure within the combustion chamber 26 increases until the pressure attains its maximum reflection pressure (Pmax) . If angle β continues to increase after the pressure reaches the maximum reflection pressure (Pmax), the pressure within the combustion chamber 26 begins to decrease. In order to continually initiate detonation, the pressure within the combustion chamber 26 must exceed a critical pressure (Pc), which is the minimum pressure required to initiate detonation at a given initiating element 44 temperature. Consequently, angle β must remain below a maximum critical angle (βmax) and above a minimum critical angle (βmin). For example, the maximum critical angle (βmax) for an oxygen/natural gas detonable mixture at a ratio of about 2 to about 7 is generally about 50° and preferably about 35°, while the minimum critical angle (βmin) is about 8° and preferably about 15°.

Unlike the converging section 34 which creates a reflection pressure, the diverging section 30 is designed to maintain the stability of the detonation process. The diverging section 30 expands from the ignition section 28 at an angle α. (See FIG. 3A) . After ignition the detonable gas mixture passes through the diverging section 30, its combustion front expands and its speed decreases which, in turn, allows the pressure within the diverging section 30 to increase facilitating transition to the detonation. Angle α is generally greater than about 15° and preferred to be about 30° to about 75° in order to decrease the speed of the combustion front and to increase the local pressure after the ignition section 22, inside of the diverging section 30.

For example, a detonation gun 10 having a diverging section 30 with an angle α of 30° and a converging section 34 with an angle β of 15° was employed to coat a substrate with an Amperit 526.062 coating powder being introduced to the detonation gun 10 at a spray rate of about 4 kg/hr. Natural gas was supplied to the ignition section 28 at a flow rate of 10 liters/minute while oxygen and air, combined to form the oxidant gas, were supplied at respective flow rates of 47 liters/minute and 12 liters/minute. The deposition efficiency was 80%, i.e. 80% of the powder introduced to the detonation gun 10, adhered to the substrate 42. Furthermore, a detonation rate of 55 detonations per second was achieved.

The detonation gun of the present invention not only surpassed the detonation rate of prior art detonation guns by a factor of more than 5 while using similar gas flow rates and maintaining equivalent quality characteristics such as coating density and porosity, but this detonation gun is capable of attaining a detonation rate up to or exceeding about 100–300 detonations per second. In addition, this detonation gun is self sustained, such that the detonation rate of the detonation gun is not limited by the constrains of any firing device such as a spark plug. Rather, this detonation gun ignites a combustible ressure originates.

It will be understood that various modifications may be made to the embodiments disclosed herein. For example, the initiating element 44 may not be necessary if the temperature of the fuel and oxidant gas is sufficient to combine with the pressure within the combustion chamber 26 to ignite the combustible gas mixture. In addition, the initiating element 44 may be heated by a means other than electricity, or the capacitor portion 48 of the initiating element 44 may be constructed of a material that has a higher heat capacity than specified within. Furthermore, compressing the combustion chamber 26 could cause a second pressure peak within the combustion chamber 26 sufficient to ignite the combustible mixture. Therefore, the above description should not be construed as limiting, but merely as exemplifications of the preferred embodiments. Those skilled in the art will envision other modifications within the scope and spirit of the claims appended hereto.

What is claimed is:

1. A self sustained detonation apparatus (10), comprising:

a combustion chamber (26) having a closed end (46), an open end (47), and a volume sufficient to initiate detonation therein;

a means (12) for introducing fuel to said combustion chamber (26);

a means (14) for introducing oxidant gas to said combustion chamber (26);

a means (44) for igniting the fuel and the oxidant gas in said combustion chamber (26); and a means (34) for creating a secondary pressure within said combustion chamber (26), wherein said means (34) for creating a secondary pressure is configured for establishing an environment which, after a detonation cycle, causes the igniting means (44) to ignite the fuel and oxidant gas and initiate a subsequent detonation cycle;

a barrel (36) having an inlet and an exit, said inlet disposed adjacent to said open end (47) of said combustion chamber (26);

a means (38) for introducing a powder to the apparatus such that the powder departs the apparatus (10) through said exit of said barrel (36).

2. The self sustained detonation apparatus according to claim 1, further comprising: a labyrinth (25) or valve for preventing combustion from extending from said combustion chamber (26) into said means (14) for introducing oxidant gas; and a second labyrinth (25) or valve for preventing combustion from extending from said combustion chamber (26) into said means (12) for introducing fuel.

3. The self sustained detonation apparatus according to claim 1, where in said means (12) for introducing fuel and said means (14) for introducing oxidant gas is a mixing chamber (16) communicating with said combustion chamber (26).

4. The self sustained detonation apparatus according to claim 1, wherein said means for igniting is an initiating element (44) capable of absorbing sufficient energy from the detonation to attain a sufficient temperature to ignite the fuel and oxidant gas and initiate a subsequent detonation cycle at the secondary pressure.

5. The self sustained detonation apparatus according to claim 4, which further comprises a means (40) for creating a spark, wherein said means (40) for creating a spark ignites the combustible fuel and oxidant gas in the apparatus (10) until said initiating element (44) attains a sufficient temperature, in combination with the secondary pressure, to ignite the fuel and oxidant gas.

6. The self sustained detonation apparatus according to claim 5, wherein said initiating element further comprises a nichrome capacitor portion **(48*a*) and an insulating portion (50*a*)**.

7. The self sustained detonation apparatus according to claim 4, wherein said initiating element (44) is electrically heated.

8. The self sustained detonation apparatus according to claim 1, wherein said combustion chamber (26) further comprises: a converging section (34) having an upstream opening and a downstream opening which forms said open end (47), said upstream opening converges to said downstream opening at an angle β; and an ignition section (28) extending from said closed end (46) toward said upstream opening (47).

9. The self sustained detonation apparatus according to claim 8, where in said angle β is about 50° or less.

10. The self sustained detonation apparatus according to claim 8, where in said angle β is about 8° to about 35°.

11. A self sustained detonation apparatus (10), comprising:

a combustion chamber (26) having a closed end (46), an open end (47), and a volume sufficient to initiate detonation therein;

a means (12) for introducing fuel to said combustion chamber (26);

a means (14) for introducing oxidant gas to said combustion chamber (26);

a means (44) for igniting the fuel and the oxidant gas in said combustion chamber (26); and a means (34) for creating a secondary pressure within said combustion chamber (26), wherein after a detonation, said means for igniting, in combination with said means (34) for creating a secondary pressure, establishes an environment which causes fuel and oxidant gas to ignite and initiate a subsequent detonation;

wherein said combustion chamber (26) further comprises: a converging section (34) having an upstream opening and a downstream opening which forms said open end (47), said upstream opening converges to said downstream opening at an angle β; and an ignition section (28) extending from said closed end (46) to said upstream opening (47); and further comprising a diverging section (30) having a first opening and a second opening, said diverging section (30) diverges from said first opening to said second opening at an angle α, said diverging section (30) interposed between said ignition section (26) and said converging section (34), with said second opening disposed adjacent to said upstream opening of said converging section (34), wherein said diverging section (30) and initiating section (28) have a sufficient combined volume to initiate detonation prior to said converging section (34).

12. The self sustained detonation apparatus according to claim 11 wherein said angle α is greater than about 15°.

13. The self sustained detonation apparatus according to claim 11, further comprising an intermediate section (32) having a length, said intermediate section (32) interposed between said diverging section (30) and said converging section (34).

14. The self sustained detonation apparatus according to claim 13, further comprising a means to adjust the length of said intermediate section (32).

15. A self sustained detonation apparatus, comprising;

a barrel (36) having an inlet and an exit;

a means (38) for introducing a powder to the apparatus (10) such that the powder departs the apparatus through said exit;

a combustion chamber (26) having a closed end (46), an open end (47), an ignition section (28), a converging section (34), and a volume sufficient to initiate detonation prior to said converging section (34), said ignition section (28) extending from said closed end (46) toward said converging section (34), said converging section having an upstream opening and a downstream opening which forms said open end (47), said upstream opening converges to said downstream opening at a sufficient angle β to cause detonation waves to reflect off said converging section (34) back toward said ignition section (28) to create a secondary pressure within said combustion chamber (26);

a means (12) for introducing fuel to said combustion chamber (26);

a means (14) for introducing oxidant gas to said combustion chamber (26);

a means (25) for preventing combustion from extending from said combustion chamber (26) into said means (12) for introducing oxidant gas; and a means (25) for preventing combustion from extending from said combustion chamber (26) into said means (12) for introducing fuel; and an initiating element (44) capable of attaining a temperature sufficient to ignite the fuel and oxidant gas in combination with the secondary pressure, said initiating element (44) located in said combustion chamber (26).

16. The self sustained detonation apparatus according to claim 15 further comprising a diverging section (30) having a first opening and a second opening, said diverging section (30) diverges from said first opening to said second opening at an angle α, said diverging section (30) interposed between said ignition section (28) and said converging section (34) with said second opening disposed adjacent to said upstream opening of said converging section (34).

17. The self sustained detonation apparatus according to claim 16 further comprising an intermediate section (32) having a length, said intermediate section interposed between said diverging section (30) and said converging section (34).

18. The self sustained detonation apparatus according to claim 17 further comprising a means to adjust the length of said intermediate section (32).

19. The self sustained detonation apparatus according to claim 15 further comprising a spark creating device (40) for igniting the fuel and the oxidant gas until the temperature of said initiating element (44) is sufficient, in combination with the secondary pressure, to ignite the fuel and oxidant gas, said spark creating device (40) located within said combustion chamber.

20. The self sustained detonation apparatus according to claim 15 wherein said initiating element (44) is electrically heated.

21. A method for sustained detonation in a detonation coating apparatus, comprising the steps of:

supplying fuel and oxidant gas to a combustion chamber (26);

igniting said fuel and oxidant gas to create a detonation cycle;

creating a secondary pressure within said combustion chamber (26); and heating an initiating element (44) to a sufficient temperature to ignite additional fuel and oxidant gas within the combustion chamber (26) at said secondary pressure, which will cause a subsequent detonation cycle.

22. A method as in claim 21 further comprising introducing a powder in front of said detonation wave such that said powder is propelled onto a substrate (42).

23. A method as in claim 21 further comprising mixing said combustible fuel and oxidant gas.

24. A method as in claim 21 further comprising preventing a detonation cell from entering means for supplying fuel (12) and oxidant gas (14).

25. A method as in claim 21 wherein said creating wave within said combustion chamber off of an angled section of said combustion chamber.

26. A self sustained detonation coating apparatus (10) for coating a substrate with a powder propagated onto the substrate, comprising:

a combustion chamber (26) having a closed end (46), an open end (47), and a volume sufficient to initiate detonation therein;

means (12) for introducing fuel to said combustion chamber (26);

means (14) for introducing oxidant gas to said combustion chamber (26);

means (44) for igniting the fuel and the oxidant gas in said combustion chamber (26);

means (34) for creating a secondary pressure within said combustion chamber (26), wherein said means (34) for creating a secondary pressure is configured for establishing an environment which, after a detonation cycle, causes the igniting means (44) to ignite the fuel and oxidant gas and initiate a subsequent detonation cycle; and means (38) for introducing a powder to the apparatus such that the powder is propagated by a detonation cycle to exit the apparatus and to coat the substrate.

* * * * *